US006553683B1

(12) United States Patent
Klass et al.

(10) Patent No.: US 6,553,683 B1
(45) Date of Patent: Apr. 29, 2003

(54) METHOD AND APPARATUS FOR GENERATING A TEMPLATE

(76) Inventors: Kevin M. Klass, 990 San Antonio Rd., Palo Alto, CA (US) 94303; Walter I. Matthews, III, 1719 Drake Ct., Petaluma, CA (US) 94954

( * ) Notice: Subject to any disclaimer, the term of this patent is extended or adjusted under 35 U.S.C. 154(b) by 0 days.

(21) Appl. No.: 09/519,001

(22) Filed: Mar. 3, 2000

(51) Int. Cl.[7] ..... G01B 3/14; E04F 21/04

(52) U.S. Cl. ..... 33/562; 33/1 AP; 33/456; 33/194

(58) Field of Search ..... 33/562, 1 N, 1 AP, 33/456, 452, 453, 457, 458, 459, 460, 461, 462, 463, 464, 465, 194, 561.1, 561.2, 561.3, 495–500, 471–473; 434/215, 216

(56) References Cited

U.S. PATENT DOCUMENTS

| | | | | | |
|---|---|---|---|---|---|
| 509,582 | A | * | 11/1893 | Ort | 33/194 |
| 773,176 | A | | 10/1904 | Washington | 33/194 |
| 937,816 | A | | 10/1909 | Koerner | 33/194 |
| 1,004,471 | A | * | 9/1911 | Rose | 33/194 |
| 1,115,030 | A | | 10/1914 | Smith | 33/194 |
| 1,268,620 | A | | 6/1918 | Renstrom | 33/456 |
| 1,442,136 | A | * | 1/1923 | Eads | 33/194 |
| 1,559,386 | A | | 10/1925 | Valentine | 33/452 |
| 1,661,096 | A | | 2/1928 | Rowe | 33/456 |
| 1,791,822 | A | | 2/1931 | Lundquist | 33/194 |
| 2,093,048 | A | * | 9/1937 | Ike | 33/453 |
| 2,502,166 | A | | 3/1950 | McKay | 33/194 |
| 2,867,911 | A | | 1/1959 | Atkinson | 33/194 |
| 2,973,584 | A | * | 3/1961 | Snapp | 33/194 |
| 3,514,863 | A | * | 6/1970 | Moll | 33/764 |
| 4,097,999 | A | * | 7/1978 | Nowlin | 33/500 |
| 4,223,445 | A | | 9/1980 | Goodland | 33/194 |
| 4,423,555 | A | * | 1/1984 | Wootten | 33/571 |
| 4,472,883 | A | * | 9/1984 | Ortega | 33/518 |
| 4,562,649 | A | * | 1/1986 | Ciavarella | 33/419 |
| 4,827,625 | A | | 5/1989 | Le Moal | 33/527 |
| 5,040,298 | A | * | 8/1991 | Weber | 33/1 N |
| 5,241,756 | A | * | 9/1993 | King | 33/561.1 |
| 5,375,334 | A | * | 12/1994 | Coker | 33/194 |
| 5,692,357 | A | * | 12/1997 | McCain | 52/749.1 |
| 5,732,474 | A | * | 3/1998 | Cannon | 33/452 |

FOREIGN PATENT DOCUMENTS

| | | |
|---|---|---|
| EP | 0 454 626 A2 | 4/1991 |

* cited by examiner

*Primary Examiner*—Diego Gutierrez
*Assistant Examiner*—R. Alexander Smith
(74) *Attorney, Agent, or Firm*—Larry D. Johnson; Craig M. Stainbook; Johnson & Stainbrook, LLP

(57) ABSTRACT

A method for defining a regular or irregular shape utilizes a template apparatus including a plurality of radially-adjustable corner members connected by length-adjustable straight edge members. The corner members include an angle scale to display the defined angle, while the edge members include a length scale to display the defined length of that edge.

5 Claims, 4 Drawing Sheets

METHOD AND APPARATUS FOR GENERATING A TEMPLATE

BACKGROUND OF THE INVENTION

1. Field of the Invention

This invention relates generally to tools and hardware, and more specifically to an improved method and apparatus for generating a template for applications in, inter alia, the glass, mirror, marble and countertop cutting, fitting and installation industries.

2. Description of the Prior Art

Some construction situations involve fabrication and installation of a piece of material that is odd-sized, non-symmetrical, or otherwise irregular in shape, for example, the cutting and placement of a piece of glass into an irregular polygon window frame. One known method of defining the irregular shape is to construct a template of that shape, and later use that template to cut the glass. To make a template several methods have been used:

a. A solid plywood sheet may be cut to the desired shape.

b. Strips of plywood may be tacked or hot glued together to define the desired shape.

c. A sheet of cardboard or paper may be cut out to the desired shape.

In each example the physical template must usually be shipped to the fabrication shop to be used once, stored for a period of time, and then disposed. Problems with this method include loss or damage in shipping, time delays due to shipping, waste of materials, cost of shipping, considerable labor to fabricate and considerable storage space required.

Instead of making a physical template, the irregular shape may be defined by taking and recording measurements. For example:

a. Using a 48" carpenters level, offset measurements from the plumb and level are taken from one corner of the irregular shape and marked on a field sketch. Then, width and length measurements are taken at the top, bottom, left and right sides and recorded.

b. On a wall using a carpenters level draw a plumb and level line bisecting the space to be measured. This forms four 90 degree corners and four quadrants. Extend the lines to the perimeter of the space to be fitted. Take and record linear measurements from the ends of these lines to each corner.

The problems with these and other measurement methods include: bubble level readings can be inaccurate; measuring does not account for convex or concave walls or floors; and without a physical template at the installation site there is no way to test ingress clearances for the glass or mirror to get to the installation site and in situ from the outside. In addition, levels are useless when fitting a template on ships or houseboats.

Many tools have been developed for measuring lengths and angles, and arguably could be used to define a shape. For example, Washington U.S. Pat. No. 773,176 discloses a device for fitting doors to their frames. Koerner U.S. Pat. No. 937,816 teaches a door and window pattern capable of adjustment for asymmetrical frames. Smith U.S. Pat. No. 1,115,030 teaches a pattern device that can be adjusted within the frame or opening, and includes hinged sections for compaction. Lundquist U.S. Pat. No. 1,791,822 teaches a door template with indicators for the placement of door hinges. McKay U.S. Pat. No. 2,502,166 discloses a gauge and method for mounting and securing doors. Atkinson U.S. Pat. No. 2,867,911 teaches a door fitting template for measurement of a door opening. Goodland U.S. Pat. No. 4,223,445 discloses a carpentry measuring tool with pivoting arms.

Renstrom U.S. Pat. No. 1,268,620 teaches a measuring instrument having a plurality of ruler-like sections pivotally connected and including a protractor/vernier scale. Valentine U.S. Pat. No. 1,559,386 discloses a carpenter's gauge with a plurality of straight-edges pivotally and telescopically connected together. Rowe U.S. Pat. No. 1,661,096 discloses a mathematical instrument having a series of straight edges and one or more sliding protractors. LeMoal U.S. Pat. No. 4,827,625 shows a template for cutting tiles having a deformable frame including hinged and extensible sides. Trabucco EPO Patent 454-626A discloses a frame-shaped template with adjustable corner angles for use with tile laying on curving stair steps.

However, none of the above references, alone or in combination, provide a circular compass and vernier that can be placed flush into a corner to define the angle therein. In addition, none of the references, alone or in combination, provide a plurality of expandable continuous straight edges with readouts on each side, that when attached form intersecting lines. Furthermore, none of the references provide an apparatus that will lay flat on the surface to be measured and the surface of the material to be cut. Also, none of the references have the capability to display the corner angles and side length dimensions of the space being measured, enabling the user to communicate those angles and dimensions only (and not the physical template itself) to another location for reproduction of the template. Finally, none of the references, alone or in combination, teach or even suggest a method for generating a template with radially-adjustable corners and length-adjustable straight edges that will fit into a poly-sided opening and display the requisite lengths and angles to accurately define the opening, so that the information can be used to remotely recreate the template.

SUMMARY OF THE INVENTION

The method and apparatus for generating a template of this invention utilizes a template apparatus having radially-adjustable corners and length-adjustable straight edges that when assembled and fitted into a poly-sided opening or space will create a replica or template of that space, and which is described numerically by a series of angle and length measurements that are read from scales on the tool. These measurements, when recorded onto a paper form showing the layout and position of each, may be transmitted (e.g., by facsimile, phone, or hard copy) from the contractor to the fabrication shop. The fabricator then reconstructs the template from these measurements using another (complementary) template maker set in the shop. The template maker is then used to lay out cut lines on glass, mirror, marble or other materials to be cut and fitted into the opening or space.

The inventive template maker thus eliminates the problems associated with construction of a physical template because the template information is transmitted and stored as measurements on paper, and not as a physical replica. The inventive template maker combines the advantages of making a physical template with the convenience of recorded measurements while eliminating the pitfalls of each. The adjustable straight edges account for variations in the abutting walls, floor moldings and other abutments. The adjustable corners accurately measure the angles of all corners. The configured template also provides a way to check the ingress of the finished product in situ.

Features and benefits of the inventive apparatus include:

1. Each corner indicates the angle.
2. Each set of straight edges indicates the length.
3. Corner brackets hold the corner in position during handling.
4. A series of small holes in the straight edges provide a means of tacking the assembly up into position.
5. Each corner has a handle for locking it into the desired position.
6. Each adjustable straight edge pair has a knob for locking it into the desired position.
7. Measurements can be transmitted (by facsimile or other method) and used to recreate the desired shape at a remote location with another (complementary) template maker set.
8. When used together with the facsimile form a single set can produce many different templates. By recording the measurements in one configuration and then re-configuring the template for the next shape to be measured, the apparatus eliminates the need to build and ship individual templates for each shape.
9. Metal construction is less affected by the environment than conventional wood templates.
10. The template maker can be reused many times.

Alternate embodiments of the inventive apparatus include:

1. Corners and straight edges may be equipped with a digital readout indicating the measurement.
2. Larger models may be proportioned larger, while smaller models may be proportioned smaller.
3. Metric versions may be made.

The inventive method preferably includes the steps of:

placing the template apparatus into the opening to be measured;

adjusting the adjustable-angle corner members and adjustable-length edge members to fit within and define the shape of the opening (and, if necessary, securing the corner members and edge members);

reading (and, if necessary, recording) the angle measurements from the corner members and the length measurements from the edge members; and removing the template apparatus from the opening.

Further steps may include:

manipulating the same or a second template apparatus to conform to the angle measurements and length measurements read from the template apparatus in the opening measured; and marking the shape defined by the template apparatus on an article to be cut.

BRIEF DESCRIPTION OF THE DRAWINGS

FIG. 4A illustrates a five-sided polygon;

FIG. 4B illustrates a four-sided polygon;

FIG. 4C illustrates an alternate five-sided polygon;

FIG. 4D illustrates a six-sided polygon;

FIG. 4E illustrates an alternate six-sided polygon;

FIG. 4F illustrates a regular four-sided polygon (square);

FIG. 4G illustrates a regular three-sided polygon (triangle); and

FIG. 4H illustrates an eight-sided polygon.

DETAILED DESCRIPTION OF A PREFERRED EMBODIMENT

Figure 1:
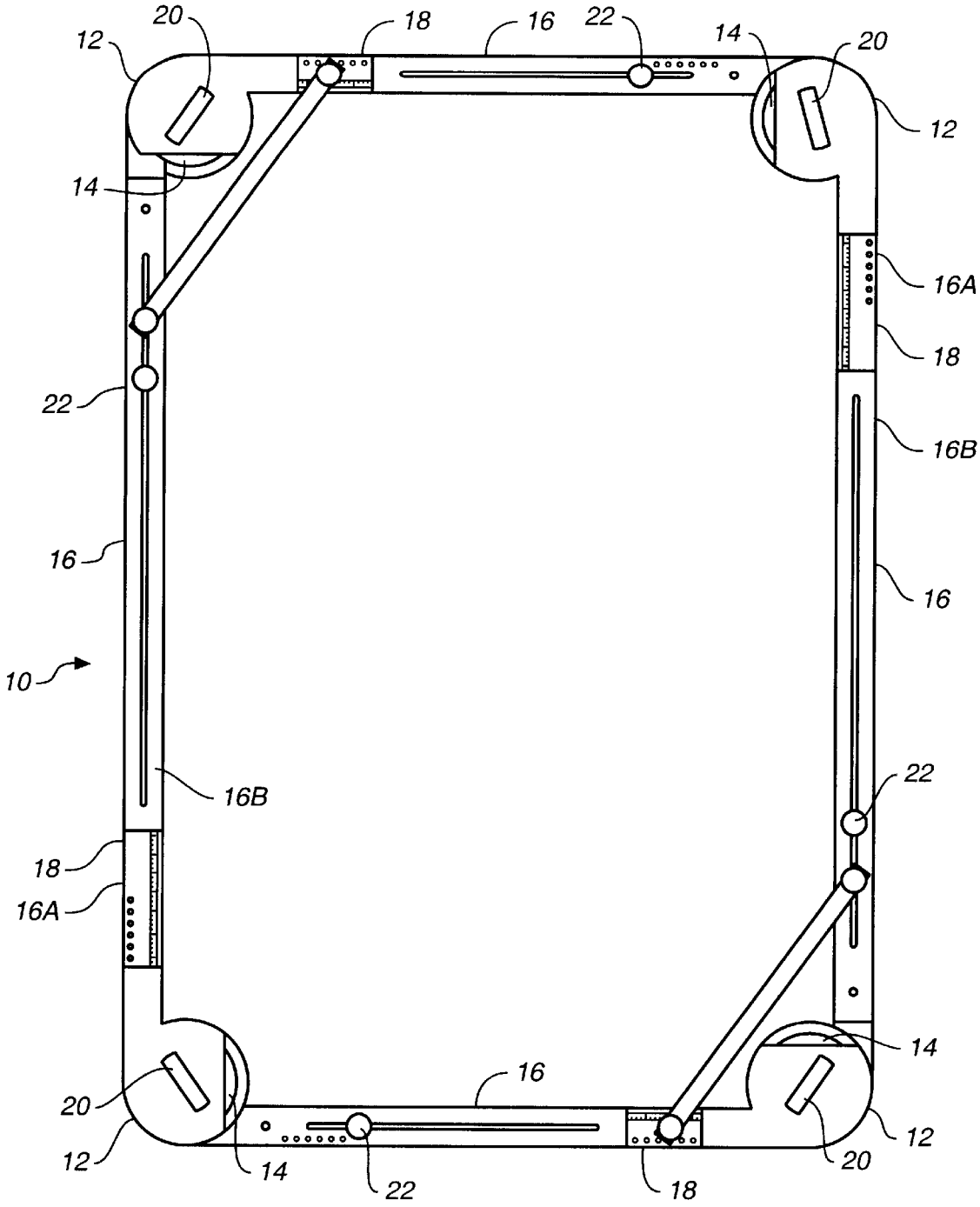
FIG. 1 is a plan view of a template maker of this invention, illustrating a plurality of adjustable-angle corner members each bearing an angle scale, connected to one another by a plurality of adjustable-length edge members each including a length scale.

FIG. 1 is a plan view of a template maker 10 of this invention, illustrating a plurality of adjustable-angle corner members 12 each bearing an angle scale 14, connected to one another by a plurality of adjustable-length edge members 16 each including a length scale 18. Each corner member 12 is positioned at the ends of the adjoining adjustable-length edge members, so that the corner member can be placed into the true corner of the space being measured, without interference by the edge members. Each corner member 12 preferably includes a corner lock 20 (e.g., a knob on a threaded shaft) which enables free angular movement when loosened, but can be tightened to lock the corner member into a desired angularity when placed into position on a wall or other surface. Each edge member 16 similarly preferably includes a locking knob 22 which enables free extension and retraction of the respective segments of the edge member (described infra) when loosened, but can be tightened to lock the edge member into a desired length when placed into position. The length scale on the graduated rail 16A displays the overall outside dimension at the edge of the slide rail 16B. These rails preferably telescope relative to one another to enable length adjustment without physically extending beyond the corner members.

Figures 2, 2A, 2B, 2C:
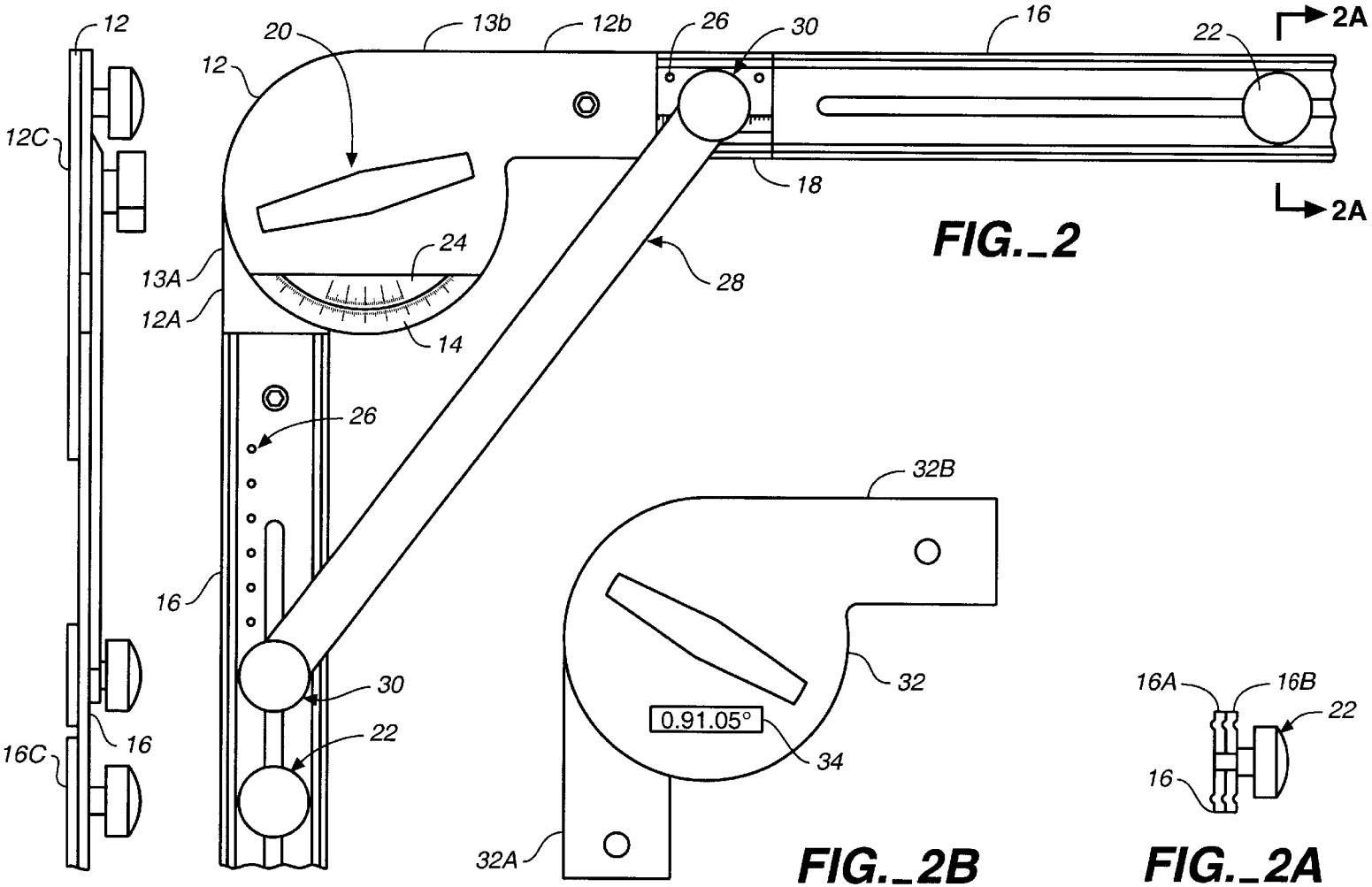
FIG. 2 is a cutaway plan view of one corner of the template maker of FIG. 1, illustrating the corner member with an angle scale and vernier scale, connected to a pair of edge members each having a length scale and bearing nail holes to fix the apparatus to a wall or other surface, with a stabilizer bar connecting the two edge members for stability.
FIG. 2A is an end elevation cross-sectional view of an adjustable-length edge member of the template maker of FIG. 2, this view taken along line 2A—2A of FIG. 2.
FIG. 2B is a plan view of an alternate embodiment of an adjustable-angle corner member, including a digital readout in place of an angle/vernier scale.
FIG. 2C is a side elevation view of one corner of the template maker, illustrating the flush, planar relationship of the base of the corner members and the base of the edge members.

FIG. 2 is a cutaway plan view of one corner of the template maker of FIG. 1, illustrating the corner member 12 with an angle scale 14 and vernier (fine) scale 24, connected to a pair of edge members 16 each having a length scale 18 and bearing nail holes 26 to fix the apparatus to a wall or other surface. A stabilizer bar 28 connects the two adjacent edge members 16 for stability. Stabilizer bar knobs 30 may be used to secure the stabilizer bar to the respective edge members, in the manner previously described. The edges 13*a*, 13*b* of the legs of the corner member extend tangentially from the outermost surface of the corner member 12, which tangent is continued by the edge members 16. This arrangement enables the corner member to be placed flush into the corner it is measuring, without interference by any part of the structure of the device.

Angle scale 14 displays the angle defined by the respective legs 12A, 12B of corner member 12, as is well known in such angle-measuring devices.

FIG. 2A is an end elevation cross-sectional view of an adjustable-length edge member 16 of the template maker of FIG. 2, this view taken along line 2A—2A of FIG. 2. The edge member 16 preferably includes a first (graduated) rail 16A forming an interlocking surface beneath a second (covering) sliding rail 16B, with knob 22 enabling selective loosening or tightening of the rails, as is well known in the art.

FIG. 2B is a plan view of an alternate embodiment 32 of an adjustable-angle corner member, including a digital readout 34 in place of an angle/vernier scale. This digital readout similarly displays the relative angle defined by the respective legs 32A, 32B of the corner member, again as is well known in the art. The digital readout could be powered by an internal battery or other means.

FIG. 2C is a side elevation view of one corner of the template maker, illustrating the flush, planar relationship of the base 12C of the corner members 12 and the base 16C of the edge members 16. This feature of a flat base, with no protuberances, enables the device to lay flat on the surface it being measured (e.g., a wall), and also lay flat on the surface of the material being cut. This eliminates problems of offset and parallax, and can be critical when measuring in shallow areas, and transferring the true measurement (e.g., by marking the glass or other material being cut).

Figure 3:
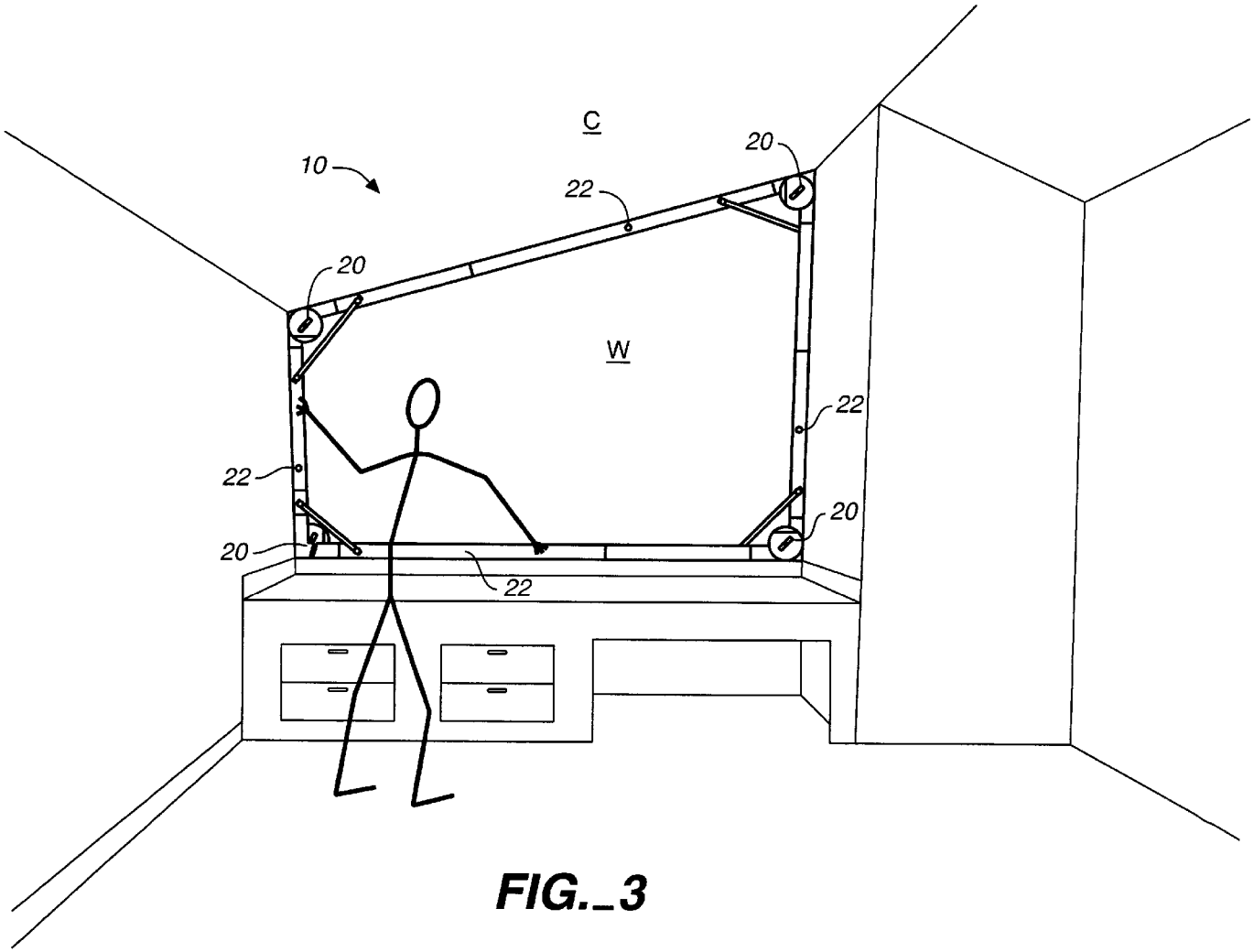
FIG. 3 is a pictorial perspective view of a template maker of this invention in use to make a template to fit a mirror onto a wall having an inclined ceiling.

FIG. 3 is a pictorial perspective view of a template maker 10 of this invention in use to make a template to fit a mirror onto a wall W having an inclined ceiling C. The user simply places the apparatus 10 into position on the irregular-shaped wall W, with the corner locks 20 and edge member locking knobs 22 all loosened, so that the edges of the combined apparatus may be freely adjusted in both angle and length to fit the irregular shape. Once the fit has been made, the respective locks can be engaged, and the angle and length information read from the respective displays.

Figure 4A:
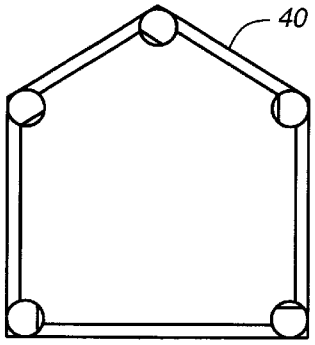
FIGS. 4A–4H are a series of plan views of alternate configurations that may be produced using the template maker of this invention.
Figure 4B:
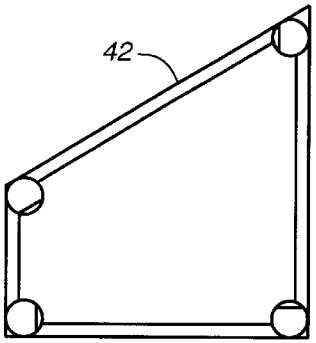
Figure 4C:
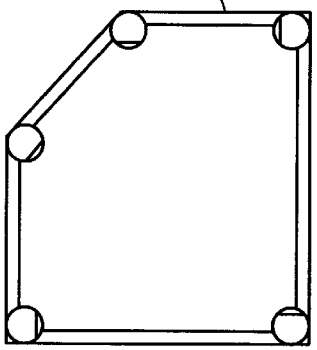
Figure 4D:
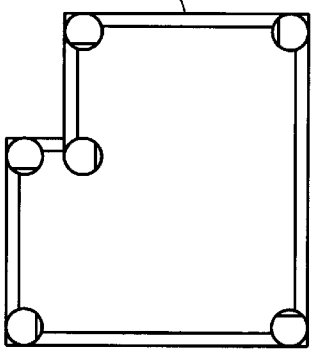
Figure 4E:
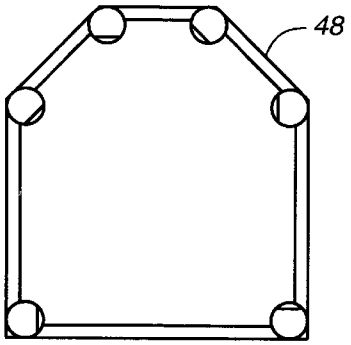
Figure 4F:
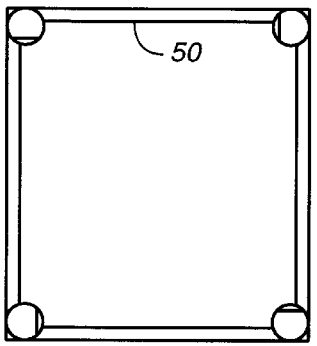
Figure 4G:
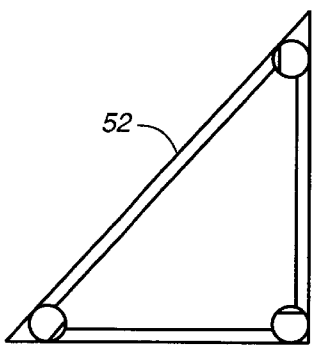
Figure 4H:
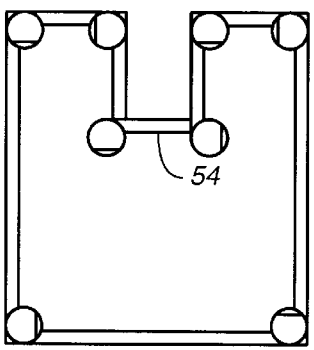

FIGS. 4A—4H are a series of plan views of alternate configurations that may be produced using the template maker of this invention. FIG. 4A illustrates a five-sided polygon 40 such as may be encountered at the peak of a ceiling. FIG. 4B illustrates a four-sided polygon 42 such as may be encountered with an inclined ceiling (such as in FIG. 3). FIG. 4C illustrates an alternate five-sided polygon 44 such as may be encountered in the corner of a room having a partially inclined ceiling, or as a common table top or counter top surface. FIG. 4D illustrates a six-sided polygon 46 such as might be encountered in similar circumstances. FIG. 4E illustrates an alternate six-sided polygon 48 such as might be encountered in the center of a room having a partially inclined ceiling. FIG. 4F illustrates a regular four-sided polygon (square) 50, for which the inventive apparatus would be useful to define minor fluctuations in length and/or angularity. FIG. 4G illustrates a regular three-sided polygon (triangle) 52 for which the inventive apparatus could again be used for such fine accuracy. Finally, FIG. 4H illustrates an eight-sided polygon 54, which shape is frequently encountered around abutting walls, beams, duct work, or the like. Note that the inventive apparatus can be used to define the shape occupied by an essentially infinite number of configurations in addition to those depicted, by proper selection of appropriate lengths of the edge members utilized. The template apparatus may include a minimum of three corner members connected to three edge members, the minimum required to define a closed geometric figure. Beyond this basic configuration, the inventive apparatus may include any number of corner members (with a corresponding number of edge members) to define any geometric shape.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A method for generating a template for defining a shape, said method comprising the steps of:

placing a template apparatus into an opening to be measured, the template apparatus including a plurality of adjustable-angle corner members, each said corner member bearing an angle scale adapted to display the angle defined by the corner member, and a plurality of adjustable-length edge members connecting the corner members to each other at the ends of the edge members, each said edge member including a length scale adapted to display the length defined by the edge member;

adjusting the adjustable-angle corner members and adjustable-length edge members to fit the template apparatus within the shape of the opening;

reading the angle measurements from the corner members and the length measurements from the edge members;

transmitting the angle and length measurements read from the template apparatus to a second location;

providing a template apparatus at the second location: and manipulating the corner members and edge members of the template apparatus at the second location to conform to the angle measurements and length measurements to recreate the shape of the opening.

2. The method of claim 1 further including the step of marking the shape defined by the template apparatus on an article to be cut.

3. The method of claim 1 further including the step of securing the corner members and edge members before reading the angle measurements from the corner members and length measurements from the edge members.

4. The method of claim 1 further including the step of recording the angle measurements from the corner members and length measurements from the edge members.

5. The method of claim 1 further including the step of moving the configured template apparatus from the opening to test ingress of an article to be cut.

* * * * *